US005972121A

United States Patent [19]

L'Hermine et al.

[11] Patent Number: 5,972,121

[45] Date of Patent: Oct. 26, 1999

[54] DECOLORIZATION OF SUGAR SYRUPS USING FUNCTIONALIZED ADSORBENTS

[75] Inventors: Gael Joseph Alfred L'Hermine, Chauny, France; Eric Gustave Lundquist, North Wales, Pa.

[73] Assignee: Rohm and Haas Company, Phila., Pa.

[21] Appl. No.: 09/056,139

[22] Filed: Apr. 7, 1998

[30] Foreign Application Priority Data

Apr. 9, 1997 [FR] France ..... 97 04358

[51] Int. Cl.[6] ..... C13D 3/12

[52] U.S. Cl. ..... 127/55; 127/46.2

[58] Field of Search ..... 127/55, 46.2

[56] References Cited

U.S. PATENT DOCUMENTS 3,962,077 6/1976 Pascarella et al. ..... 127/46.2

4,160,675 7/1979 Pannekeet et al. ..... 127/46.2

4,523,960 6/1985 Otte ..... 127/46.2

4,871,397 10/1989 Stevens ..... 127/55

4,950,332 8/1990 Stringfield et al. ..... 127/55

5,094,694 3/1992 LaBrie et al. ..... 127/46.2

5,416,124 5/1995 Stringfield .

*Primary Examiner*—David Brunsman

*Attorney, Agent, or Firm*—Thomas J. Howell

[57] ABSTRACT

A process for decolorizing sugar solutions by contacting them with highly crosslinked, macroporous copolymers functionalized with weak-acid or weak-base ion exchange functional groups is disclosed. Treatment of sugar syrups using macroporous functionalized adsorbents allows for multiple regeneration cycles without loss of sugar decolorization properties.

11 Claims, No Drawings

DECOLORIZATION OF SUGAR SYRUPS USING FUNCTIONALIZED ADSORBENTS

BACKGROUND

This application relates to processes for decolorization of sugar syrups, and more particularly to decolorization of sugar syrups using functionalized adsorbents containing weak-acid cation exchange groups or weak-base anion exchange groups.

Decolorization of aqueous sugar syrups derived from corn, beets and sugar cane has traditionally relied upon carbonaceous adsorbents such as bone char or powdered and granular activated carbons. Although these carbonaceous materials themselves are inexpensive, the processes employing them tend to require expensive equipment and intensive labor. In a typical industrial decolorization process, powdered carbon is used in a batch adsorption process. After decolorization the sugar syrup must be filtered, as a separate step, to remove the carbon for reclamation and regeneration. In a continuous process the sugar syrup passes through beds of granular activated carbon for decolorization; periodically a fraction of the carbon bed is removed for regeneration and that carbon is replaced by either regenerated or new carbon. Carbon regeneration is a high-temperature process requiring fuel for the regeneration furnace and carbon losses during the regeneration can approach ten weight percent. Also, thermal regeneration destroys the color bodies removed during decolorization, preventing their recovery for study or other uses.

Ion exchange resins have been proposed for sugar syrup decolorization; they permit continuous use of the treatment column and in situ regeneration using readily available chemicals such as caustic and acid, and their long operational life and less expensive equipment and handling, compared to carbon, in most cases offsets their higher initial expense. Unfortunately, ion exchange resins have a low capacity for adsorbing color bodies from solution compared to carbon and require much larger quantities of regenerants to remove the color bodies than to remove typical ionic species. Additionally, ion exchange resins do not effectively remove impurities such as HMF (5-hydroxymethyl-2-furfural) that increase the color of sugar syrups on standing and during further processing.

U.S. Pat. Nos. 4,950,332 and 5,416,124 propose using synthetic polymeric functionalized adsorbents prepared by swelling a porous styrene/divinylbenzene copolymer in a swelling solvent, adding chloromethyl groups to the polymer via a chloromethylation reaction and post-crosslinking the swollen structure with methylene groups in the presence of a Friedel Crafts catalyst, to form a macronet structure that remains when the solvent is removed. The macronet structure, however, contains a large amount of microporosity comparable to that of activated carbon, and as the above U.S. Pat. No. 5,416,124 indicates, such microporosity is expected to increase adsorption capacity but degrade adsorption and regeneration kinetics.

The present invention seeks to overcome the problems associated with prior art processes for decolorizing sugar syrups by using a functionalized adsorbent having a combination of properties not found in adsorbents heretofore available, that is, a high level of mesoporosity and macroporosity for good adsorption kinetics, stability and easy regeneration and a high adsorption capacity without the presence of microporosity.

STATEMENT OF INVENTION

According to a first aspect of the present invention there is provided a process for decolorizing sugar syrup comprising contacting sugar syrup containing color bodies with a functionalized adsorbent, the adsorbent comprising a highly crosslinked macroporous styrenic copolymer functionalized with weakly ionizing functional groups, and subsequently separating the sugar syrup from the adsorbent.

In another aspect, the present invention provides a process as described above wherein the weakly ionizing functional groups are weak-base anion exchange groups or weak-acid cation exchange groups.

DETAILED DESCRIPTION

As used herein, the term "highly crosslinked" indicates a polymer or copolymer polymerized from a monomer or mixture of monomers containing at least 65 weight percent (%), based on the total monomer weight, of polyvinyl unsaturated monomer. The highly crosslinked macroporous styrenic copolymers used in the preparation of functionalized adsorbents useful in the present invention are preferably polymerized from monomer mixtures containing at least 75% by weight polyvinyl unsaturated styrenic monomers.

The highly crosslinked macroporous styrenic copolymers are preferably spherical copolymer beads having particle diameters from 10 microns ($\mu$m) to 2 millimeters (mm), such as are produced by suspension polymerization, and preferably possess a surface area greater than 500 square meters per gram ($m^2/g$) of copolymer. These copolymer beads are preferably of the type originally described by Meitzner et al., in U.S. Pat. No. 4,382,124, in which porosity is introduced into the copolymer beads by suspension-polymerizing them in the presence of a porogen, that is, a solvent for the monomer but a non-solvent for the polymer.

The macroporous copolymers are functionalized, either with a weak-acid functional group such as a carboxylic acid group, or with a weak-base functional group such as a primary, secondary or tertiary amine functional group. The level of functionalization may be from 0.1 milliequivalent per gram (meq/g) to 3.0 meq/g of dry adsorbent, more preferably from 0.5 meq/g to 1.5 meq/g of dry adsorbent. The preferred particle size and surface area properties for the functionalized copolymers are the same as those of their macroporous copolymer precursors. As used herein, the functionalized copolymers useful in the process of the present invention are referred to as functionalized adsorbents since they remove the color bodies by an adsorption mechanism.

The copolymers used in the preparation of functionalized adsorbents useful in the present invention do not derive their surface area from alkylene-bridge crosslinks introduced into a swollen copolymer subsequent to initial polymerization, that is, they are not "macronet" or "hypercrosslinked" copolymers such as are described in, inter alia, U.S. Pat. Nos. 4,263,407 and 4S 5,416,124, or Davankov, *Reactive Polymers,* Vol. 13, pages 27–42, "Structure and Properties of Hypercrosslinked Polystyrene—The First Representative of a New Class of Polymer Networks." Accordingly, the term "macroporous" as used herein excludes such macronet copolymers.

The functionalized adsorbents useful in the process of the present invention may readily be regenerated subsequent to contact with and separation from the sugar syrup. Preferably the sugar syrup is removed from the functionalized adsorbent with water, and more preferably with water at elevated temperature. Using processes known to those having ordinary skill in the art, the functionalized adsorbents may be regenerated, subsequent to their use for decolorizing sugar syrups, by contacting them with regenerating reagents; in particular, the functionalized adsorbents containing cation-exchange functional groups may be regenerated with acids, and the functionalized adsorbents containing anion-exchange functional groups may be regenerated with bases. More preferably, either type of used, functionalized adsorbent may be regenerated by contacting the functionalized adsorbent with regenerating reagents at elevated temperature, separating each regenerating reagent from the functionalized adsorbent before introducing the next reagent, the regenerating reagents being, in the order in which they contact the functionalized adsorbent, a dilute base, water, a dilute acid and water.

The elevated temperatures suitable for contacting the used, functionalized adsorbent and the regenerating reagents in this more preferred regeneration process are from 50° C. to 100° C., preferably from 55° C. to 95° C., and more preferably from 60° C. to 90° C. The acids and bases used as regenerating reagents preferably have a concentration of 0.5 to 15% by weight, and are preferably aqueous solutions. More preferably the concentration of the regenerating reagents is from 1 to 10%, and still more preferably from 2 to 6%, by weight.

Hot water alone may also be used as a regenerating reagent for the functionalized adsorbents. The hot water used for regenerating the functionalized adsorbents preferably has a temperature of at least 70° C., more preferably at least 80° C., and still more preferably at least 90° C. Although regeneration with hot water under atmospheric pressure is restricted to an upper temperature limit of 100° C., where hot water alone is used for regenerating the functionalized adsorbent, more preferably pressures higher than atmospheric are used, up to about five atmospheres and the maximum temperature is 150° C., preferably 120° C. The relationship between the maximum temperature of hot water and pressure is well known to those having ordinary skill in the art.

Further, using the regeneration processes described above, the adsorbed color bodies may be eluted from the functionalized adsorbent during regeneration in a substantially unchanged state, dependent upon the regenerant selected, so that the regeneration process concentrates them for easy recovery. As these color bodies contain various flavonoids and polyphenolics, currently believed to be the constituents of red wine which are responsible for decreasing the risk of heart disease, it is expected that they will be the subject of considerable investigation, and may provide considerable therapeutic value. Thus their easy concentration and recovery after regeneration is seen as another advantage of the process of the present invention.

The process of the present invention may be carried out either as a batch process, in which functionalized adsorbent and sugar syrup are mixed together and subsequently filtered to separate them, or as a continuous process, in which the sugar syrup is passed through a bed of the functionalized adsorbent. A batch process is exemplified in Examples 5 and 6, below, while a continuous process is exemplified in Example 7, below. In the batch process, preferred amounts of the functionalized adsorbent are from 0.5% to 25% by weight, more preferably from 1% to 15% by weight, based upon the total weight of the syrup to be treated. In the continuous process, flow rates of the syrup to be treated are preferably from 0.1 to 20 bed volumes (B.V.) per hour, more preferably from 0.5 to 5 bed volumes per hour, based upon the bed volume of the functionalized adsorbent. Configuration of the functionalized adsorbent bed may readily be chosen by one having ordinary skill in the art, based upon known bed configurations for continuous treatment of syrups, water and similar liquids.

U.S. Pat. No. 5,416,124 teaches that a high level of microporosity increases the adsorption capacity of adsorbents for small molecules, while a high level of macroporosity and mesoporosity contributes little apart from improved adsorption kinetics, and that as a result, adsorbents having a mesoporosity greater than 0.5 cubic centimeters per gram ($cm^3/g$) and microporosity less than 0.15 $cm^3/g$, generally exhibit excellent adsorption kinetics but poor adsorption capacity, while the macronetted (methylene-bridged) adsorbents, which typically have a mesoporosity of less than 0.5 $cm^3/g$ and a microporosity greater than 0.2 $cm^3/g$, tend to have higher capacity but slower kinetics.

In contrast to that teaching, we have found that the functionalized adsorbents useful in the present invention, having very low microporosity and high mesoporosity, and lacking a macronet structure, show good capacity for adsorbing color bodies from sugar syrups, together with good kinetics. We have further observed that the functionalized adsorbents useful in the present invention give better performance regarding overall removal of color bodies and color body precursors (materials that generate color upon heating) than resins having macronet structure that have been used in the prior art for sugar decolorization; functionalized adsorbents useful in the present invention also give better performance upon subsequent regeneration of the functionalized adsorbent. Functionalized adsorbents useful in the present invention preferably have a microporosity from zero to 0.2 $cm^3/g$, more preferably from zero to 0.1 $cm^3/g$ and most preferably from zero to 0.05 $cm^3/g$; a mesoporosity from 0.5 to 2 $cm^3/g$, more preferably from 0.6 to 1.8 $cm^3/g$ and most preferably from 0.8 to 1.5 $cm^3/g$; and a macroporosity from zero to 1 $cm^3/g$.

The process of the present invention may also be used in conjunction with raw sugar clarification steps, for example ultra-centrifugation and ultra-filtration such as is described in U.S. Pat. Nos. 5,468,301 and 5,468,300.

The process of the present invention is useful in decolorizing aqueous sugar syrups, thus improving the visual aesthetics of the syrups themselves and of sugars crystallized from them, and in recovery of adsorbed color bodies such as flavonoids and polyphenolics which, as discussed above, are currently believed to be the constituents of red wine responsible for decreasing risk of heart disease, and thus may possess considerable therapeutic value.

In the following examples, all reagents used are of good commercial quality unless otherwise indicated, and all percentages and ratios given herein are by weight unless otherwise indicated.

EXAMPLE 1

This example illustrates preparation of a functionalized adsorbent useful in the process of the present invention.

To a 2-liter, 4-necked flask equipped with a condenser, mechanical stirrer, thermocouple and nitrogen inlet, and containing an aqueous solution prepared by mixing together 400 g deionized water, 1.8 g gelatin, 8 g polyallyldimethylammonium chloride, 1.5 g 50% aqueous sodium hydroxide solution and 2.1 g buffer was added a monomer mixture containing 198 g divinylbenzene (80% purity), 4 g styrene, 470 g toluene and 2 g tert-butylperoctoate. Under a nitrogen atmosphere, this mixture was stirred to maintain the monomer in discrete droplets and heated to 70° C. over a 1-hour period. The monomers were allowed to polymerize at 70° C. for 12 hours, the toluene was removed from the resulting polymer beads by distillation, and the beads were allowed to dry overnight in an oven at 40° C.

The resulting macroporous polymer beads were chloromethylated by reacting 100 g of polymer beads with a solution of 285 g chlorosulfonic acid, 72 g methylal, 72 g formaldehyde, 46 g methanol, 86 g 32% aqueous hydrochloric acid solution and 24 g hydrated ferric chloride as the catalyst. This mixture was heated to 40° C. with stirring and held at that temperature for 4 hours. The reaction was then cooled to room temperature and water was added. The beads were then washed using dilute caustic. The resulting bead slurry was then transferred to a pressure reactor and aminated by adding 100 milliliters (ml) methylal and 50 ml of 40% aqueous dimethylamine, heating to 40° C. and holding at that temperature for 5 hours. The mixture was then allowed to cool and vented, and the resulting weak-base functionalized adsorbent was washed with copious amounts of 8% aqueous hydrochloric acid followed by copious amounts of water. Properties of this functionalized adsorbent are shown in Table 1.

EXAMPLE 2

This example illustrates synthesis of a functionalized adsorbent prepared according to Example 1, except that the styrene was omitted. Properties of this functionalized adsorbent are shown in Table 1.

mixture, and subsequently hydrolyzing the anhydride groups to carboxylic acid functional groups.

To a 2-liter, 4-necked flask equipped with a condenser, mechanical stirrer, thermocouple and nitrogen inlet containing an aqueous solution of 400 g deionized water, 1.8 g gelatin, 8 g polyallyldimethylammonium chloride, 1.5 g 50% aqueous sodium hydroxide solution and 2.1 g buffer was added a monomer mixture containing 198 g divinylbenzene (80% purity), 4 g methacrylic anhydride, 470 g toluene and 2 g tert-butylperoctoate. Under a nitrogen atmosphere, this mixture was stirred to maintain the desired particle size and heated to 70° C. over a 1 hour period. The reaction mixture was then allowed to polymerize at 70° C. for 12 hours; 20 grams of 50% aqueous sodium hydroxide solution were added and the toluene was removed from the resulting polymer beads by distillation. After the toluene was removed the beads were allowed to dry overnight in an oven at 40° C. The resulting weak acid functionalized adsorbent was washed with copious amounts of 8% aqueous hydrochloric acid followed by copious amounts of water. Properties of this functionalized adsorbent are shown in Table 1.

TABLE 1

Properties of Functionalized Adsorbents

| Sample | Example 1 | Example 2 | Example 3 | Example 4 | Adsorbent 5 | Adsorbent 6 |
|---|---|---|---|---|---|---|
| Properties | | | | | | |
| MHC | 54.5% | 62.4% | 62.5% | 67.2% | 55.7% | 56.9% |
| Solids | 45.5% | 37.6% | 37.5% | 32.8% | 44.3% | 43.1% |
| Vol Cap (meq/ml) | 0.27 | 0.22 | 0.55 | | 0.19 | 0.35 |
| TAEC (meq/g) | 0.85 | 0.82 | 2.11 | | 0.60 | 1.17 |
| CEC (meq/g) | | | | 1.05 | | |
| Porosimetry | | | | | | |
| Surface area ($m^2/g$) | 599 | 637 | 577 | 940 | 1191 | 1017 |
| Porosity ($cm^3/g$) | | | | | | |
| Total | 0.99 | 1.27 | 1.37 | 1.85 | 1.05 | 1.01 |
| Micro (t-plot) | 0.02 | 0.02 | 0.00 | 0.06 | 0.46 | 0.40 |
| Meso | 0.90 | 1.05 | 1.03 | 1.29 | 0.24 | 0.20 |
| Macro | 0.07 | 0.20 | 0.34 | 0.49 | 0.35 | 0.41 |

MHC = Moisture Holding Capacity (100 - % Solids)
TAEC = Total Anion Exchange Capacity
CEC = Cation Exchange Capacity
Porosimetry was determined using a Micromeretics ASAP-2400 nitrogen Porosimeter
Porosity is reported using the following IUPAC nomenclature:
Microporosity = pores < 20 Ångstrom Units
Mesoporosity = pores between 20 and 500 Ångstrom Units
Macroporosity = pores > 500 Ångstrom Units
Adsorbents 5 and 6 are commercial products available from Dow Chemical Company, Midland, MI (USA), and have properties consistent with materials produced as described in U.S. Pat. Nos. 4,950,332 and 5,416,124, and Dowex ™ Optipore ™ Adsorbent literature published September, 1992.

EXAMPLE 3

This example illustrates synthesis of a functionalized adsorbent having a higher level of functionalization than that of Examples 1 or 2 and was prepared according to Example 1 except that the styrene was omitted. Properties of this functionalized adsorbent are shown in Table 1.

EXAMPLE 4

This example illustrates preparation of a functionalized adsorbent containing methacrylic anhydride in the monomer

EXAMPLE 5

This example illustrates decolorization of a beet-sugar syrup using the process of the present invention.

To a jacketed batch reactor containing 200 ml of a 60% Brix beet-sugar syrup with an ICUMSA color of 17,700 and pH 9.4 at 80° C. was added 10 ml of the dried functionalized adsorbent indicated in Table 2, below. This mixture was stirred for one hour, the sugar syrup was filtered to remove the functionalized adsorbent, and the ICUMSA color was measured. ICUMSA color is a spectrophotometric measurement calculated from the absorbance of light having a wavelength of 420 nanometers (nm) by the syrup using the formula:

$$ICUMSA\ \text{Color} = \frac{\text{Absorbance at 420 nm}}{(\text{Cell length in cm}) \times (\text{Syrup Concentration in g/ml})} \times 1000$$

The ICUMSA Color results are shown in Table 2, below.

TABLE 2

| Adsorbent | ICUMSA Color |
|---|---|
| Carbon* | 12,486 |
| Example 2 | 13,105 |
| Example 3 | 12,389 |
| Adsorbent 5 (comparative) | 15,173 |
| Adsorbent 6 (comparative) | 13,452 |

*DARCO ® granular activated carbon sized to pass a screen of 850 μm openings and be retained a screen of 435 μm openings, supplied by American Norit Co., Inc.

EXAMPLE 6

This example illustrates the batch decolorization of a corn syrup using the process of the present invention.

To a jacketed batch reactor containing 100 g of a 52% solids, aqueous corn syrup having an ICUMSA color of 47 and a pH of 4.65 at 80° C. was added 1 g dried adsorbent indicated in Table 3, below. This mixture was stirred for ½ hour, the sugar syrup was filtered to remove the adsorbent, and the ICUMSA color was measured. The samples were then held in a water bath at 100° C. for 1 hour, after which the After-Heat ICUMSA color was measured. The ICUMSA Color results are shown in Table 3, below.

TABLE 3

| Adsorbent | ICUMSA Color (Before Heat) | ICUMSA Color (After Heat) |
|---|---|---|
| Untreated Sugar | 47 | 67 |
| Carbon* | 12 | 38 |
| Example 1 | 11 | 20 |
| Example 4 | 28 | 33 |

*DARCO ® granular activated carbon supplied by American Norit Co., Inc., sized to pass a screen of 600-μm openings and be retained on a screen of 435-μm openings.

EXAMPLE 7

This example illustrates decolorization of a corn syrup using the process of the present invention. It further illustrates the effect of the process of the present invention upon color which develops upon subsequent heating of the syrup, the effect of loading the functionalized adsorbent with color and color-producing bodies upon color and color development after heating, and the effect of repeatedly loading and regenerating the functionalized adsorbent upon color and color development after heating. This example also illustrates the preferred column, continuous mode of operation used for the treatment of sugar in an industrial process.

A low-dextrose corn syrup of 52% solids, pH 4.65 and ICUMSA color of 47 was passed through a jacketed column containing 50 ml of functionalized adsorbent at a rate of 3 bed volumes per hour (one bed volume =50 ml). The column temperature throughout the treatment was 70° C. The effluent was collected and the ICUMSA color was measured. The samples were then placed in a water bath at 100° C. for 1 hour, after which the After-Heat ICUMSA color was measured. The results of these measurements are shown below in Tables 4 and 5. By way of comparison, untreated corn syrups typically had an initial ICUMSA color value of 40 to 50 and gave an After-Heat ICUMSA color value of 60 to 70.

Consecutive column decolorization studies were conducted to gain an understanding of the performance of the functionalized adsorbent in repeated decolorizations. Following each decolorization cycle (treatment of 190 bed volumes of syrup), two bed volumes of water were passed through the functionalized adsorbent at 70° C. to remove the sugar syrup, after which the functionalized adsorbent was backwashed with five bed volumes of water. The functionalized adsorbent was then regenerated with the following reagents in the order given, each at 70° C. and a flow rate of two bed volumes (100 ml) per hour: two bed volumes of 4% aqueous sodium hydroxide solution, two bed volumes of water, two bed volumes of 4% aqueous hydrochloric acid solution, and two bed volumes of water. Before beginning the next decolorization cycle the bed of functionalized adsorbent was "sweetened on" by passing two bed volumes of corn syrup through it. Samples taken periodically from the column effluent, during passage of 2 to 190 bed volumes of syrup through the bed, were measured for before-heat and after-heat ICUMSA color, that is, the color of the sugar syrup immediately upon eluting from the treatment column, and the color of the sugar syrup after it had been held at 100° C. for one hour. The target values for decolorized sugar are typically less than 25 ICUMSA, preferably less than 20 ICUMSA, for a "before heat" color and typically less than 45 ICUMSA, perferably less than 40 ICUMSA, for an "after heat" color. When these values are exceeded, the column has lost it's decolorization capacity and must be regenerated. The results of these studies, for the third and fourth decolorization cycles, using Example 1 and Adsorbent 5 (comparative), are presented in Tables 4 and 5, below. Using the adsorbent of Example 1 allows a significantly greater number of bed volumes to be processed (approximately 150–200 bed volumes) before exceeding the target color values and the process can be run more efficiently and economically with less regenerant being used as compared to using Absorbent 5 (approximately 100 bed volumes).

TABLE 4

Sugar Decolorization using Example 1

| Sample | B.V. Syrup | Cycle 3 Before Heat ICUMSA Color | Cycle 3 After Heat ICUMSA Color | Cycle 4 Before Heat ICUMSA Color | Cycle 4 After Heat ICUMSA Color |
|---|---|---|---|---|---|
| | 0 | 42.87 | 68.50 | 45.20 | 63.37 |
| 1 | 2 | 20.04 | 26.72 | 17.71 | 20.81 |
| 2 | 6 | 14.45 | 24.85 | 12.58 | 20.81 |
| 3 | 10 | 8.08 | 17.24 | 12.58 | 20.81 |
| 4 | 14 | 11.49 | 19.57 | 14.60 | 20.81 |
| 5 | 18 | 10.87 | 18.02 | 11.34 | 19.57 |
| 10 | 38 | 9.79 | 23.45 | 14.29 | 27.34 |
| 15 | 58 | 12.74 | 22.83 | 11.18 | 29.98 |
| 20 | 78 | 16.00 | 26.72 | 19.57 | 32.00 |
| 25 | 98 | 15.53 | 28.72 | 16.62 | 32.46 |
| 30 | 118 | 12.89 | 26.10 | 11.18 | 33.55 |
| 35 | 138 | 17.71 | 27.65 | 14.45 | 32.62 |
| 40 | 158 | 21.28 | 35.10 | 15.22 | 34.95 |
| 45 | 178 | 19.42 | 32.46 | 16.78 | 37.28 |
| 48 | 190 | 23.77 | 33.55 | 20.66 | 41.01 |

TABLE 5

Sugar Decolorization using Adsorbent 5 (comparative)

| Sample | B.V. Syrup* | Cycle 3 Before Heat ICUMSA Color | Cycle 3 After Heat ICUMSA Color | Cycle 4 Before Heat ICUMSA Color | Cycle 4 After Heat ICUMSA Color |
|---|---|---|---|---|---|
| | 0 | 42.87 | 68.50 | 45.20 | 63.37 |
| 1 | 2/4 | 0 | NM | 5.90 | 14.60 |
| 2 | 6/8 | 7.77 | 16.46 | 7.61 | 8.08 |
| 3 | 10/12 | 3.11 | 11.96 | 6.21 | 17.40 |
| 4 | 14/16 | NM | 15.00 | 10.56 | 17.86 |
| 5 | 18/20 | 4.50 | 12.74 | 8.23 | 17.24 |
| 10 | 38/40 | 11.49 | 23.14 | 13.82 | 26.25 |
| 15 | 58/60 | 12.43 | 27.96 | 19.11 | 32.77 |
| 20 | 78/80 | 15.84 | 30.19 | 19.42 | 32.62 |
| 25 | 98/100 | 22.52 | 33.55 | 20.35 | 39.61 |
| 30 | 118/120 | 20.19 | 38.83 | 23.30 | 41.63 |
| 35 | 138/140 | 24.70 | 47.06 | 20.50 | 49.86 |
| 40 | 158/160 | 18.33 | 51.26 | 32.00 | 47.69 |
| 45 | 178/180 | 21.12 | 53.43 | 24.39 | 48.15 |
| 48 | 190/192 | 23.45 | 54.68 | 27.34 | 49.08 |

*Bed Volumes treated during Cycle 3 and Cycle 4, respectively.
NM = not measured

We claim:

1. A process for decolorizing sugar syrup comprising contacting sugar syrup containing color bodies with a functionalized adsorbent, the adsorbent comprising a highly crosslinked macroporous styrenic copolymer functionalized with weakly ionizing functional groups, and subsequently separating the sugar syrup from the adsorbent; provided that the functionalized adsorbent is not a macronet copolymer.

2. The process of claim 1 wherein the adsorbent is in the form of spherical beads having a particle diameter of 10 $\mu$m to 2 mm.

3. The process of claim 2 wherein the adsorbent has a surface area of at least 500 square meters per gram of adsorbent.

4. The process of claim 3 wherein the weakly ionizing functional groups are weak-base anion exchange groups.

5. The process of claim 4 wherein the adsorbent is regenerated subsequent to contact with and separation from the sugar syrup.

6. The process of claim 3 wherein the weakly ionizing functional groups are weak-acid cation exchange groups.

7. The process of claim 6 wherein the adsorbent is regenerated subsequent to contact with and separation from the sugar syrup.

8. The process of claim 3 wherein the adsorbent is regenerated, subsequent to contact with and separation from the sugar syrup, by contacting the adsorbent with regenerating reagents at a temperature from 50° C. to 100° C., separating each regenerating reagent from the adsorbent before introducing the next reagent, the regenerating reagents being, in the order in which they contact the adsorbent, a dilute base, water, a dilute acid, and water.

9. The process of claim 8 further comprising recovery of color bodies subsequent to regeneration of the adsorbent.

10. The process of claim 1 wherein the highly crosslinked macroporous styrenic copolymer is polymerized from monomer mixtures containing at least 75 weight percent, based on total monomer weight, of polyvinyl unsaturated styrenic monomers.

11. The process of claim 1 wherein the functionalized adsorbent has a microporosity from zero to 0.2 cubic centimeters/gram and a mesoporosity from 0.5 to 2 cubic centimeters/gram.

* * * * *